US007488139B2

(12) United States Patent
Wissmann

(10) Patent No.: US 7,488,139 B2
(45) Date of Patent: Feb. 10, 2009

(54) PYRAMIDAL OR CONICAL SHAPED TAMPER HEADS AND METHOD OF USE FOR MAKING RAMMED AGGREGATE PIERS

(75) Inventor: Kord J. Wissmann, Blacksburg, VA (US)

(73) Assignee: Geopier Foundation Company, Inc., Mooresville, NC (US)

( * ) Notice: Subject to any disclaimer, the term of this patent is extended or adjusted under 35 U.S.C. 154(b) by 0 days.

(21) Appl. No.: 11/528,686

(22) Filed: Sep. 28, 2006

(65) Prior Publication Data

US 2007/0077128 A1 Apr. 5, 2007

Related U.S. Application Data

(60) Provisional application No. 60/721,594, filed on Sep. 29, 2005.

(51) Int. Cl.
*E02D 3/02* (2006.01)

(52) U.S. Cl. ..... 405/271

(58) Field of Classification Search ..... 405/271; 404/133.05, 133.1, 133.2
See application file for complete search history.

(56) References Cited

U.S. PATENT DOCUMENTS

| | | | | |
|---|---|---|---|---|
| 2,036,355 | A | 4/1936 | Orr et al. | |
| 2,437,043 | A | 3/1948 | Riemenschneider | |
| 2,917,979 | A | 12/1959 | Dening et al. | |
| 3,027,724 | A | 4/1962 | Smith | |
| 3,204,414 | A * | 9/1965 | Steuerman | 405/271 |
| 3,206,935 | A | 9/1965 | Phares | |
| 3,274,908 | A | 9/1966 | Grant et al. | |
| 3,309,877 | A * | 3/1967 | Degen | 405/271 |
| 3,327,483 | A | 6/1967 | Gibbons | |
| 4,708,529 | A | 11/1987 | Lindell | |
| 5,249,892 | A * | 10/1993 | Fox et al. | 405/233 |
| 5,797,705 | A * | 8/1998 | Kellner | 405/253 |
| 6,354,766 | B1 | 3/2002 | Fox | |
| 6,354,768 | B1 | 3/2002 | Fox | |
| 6,425,713 | B2 | 7/2002 | Fox et al. | |
| 6,505,998 | B1 * | 1/2003 | Bullivant | 405/271 |
| 7,073,980 | B2 | 7/2006 | Merjan et al. | |
| 2002/0009337 | A1 | 1/2002 | Fox et al. | |
| 2006/0088388 | A1 | 4/2006 | Wissmann et al. | |

FOREIGN PATENT DOCUMENTS

| | | |
|---|---|---|
| EP | 1234916 A2 | 8/2002 |

(Continued)

OTHER PUBLICATIONS

Roger Bullivant brochure, "RB Vibro Displacement", Nov. 2001.

(Continued)

*Primary Examiner*—Frederick L Lagman
(74) *Attorney, Agent, or Firm*—Ward and Smith, P.A.

(57) ABSTRACT

A tamper head having an elongated pyramidal or conical shape is used to construct rammed aggregate piers. The pyramidal or conical shape of the tamper head is more efficient at building up lateral earth pressure and provides for greater economy in the construction of the piers than available with existing methods that rely on tamper heads with flat bottoms and beveled sides.

30 Claims, 6 Drawing Sheets

FOREIGN PATENT DOCUMENTS

| | | | |
|---|---|---|---|
| EP | 1498550 | A2 | 1/2005 |
| FR | 616 470 | | 2/1927 |
| GB | 369816 | | 3/1932 |
| GB | 2 286 613 | | 8/1995 |
| IT | 565 012 | | 8/1956 |

OTHER PUBLICATIONS

PCT International Preliminary Report on Patentability for PCT/US06/037932 dated Apr. 10, 2008.
European Search Report for Patent Application No. EP 06815717.1 dated Sep. 17, 2008.

* cited by examiner

PYRAMIDAL OR CONICAL SHAPED TAMPER HEADS AND METHOD OF USE FOR MAKING RAMMED AGGREGATE PIERS

This application is entitled to and hereby claims the priority of co-pending U.S. Provisional application Ser. No. 60/721,594 filed Sep. 29, 2005.

FIELD OF THE INVENTION

The present invention relates to the installation of aggregate piers in foundation soils for the support of buildings, walls, industrial facilities, and transportation-related structures. In particular, the invention is an improvement to the method and apparatus for the efficient installation of rammed aggregate piers through the use of an improved tamper head, generally in the shape of an elongated pyramid or cone. The pyramidal and conical tamper heads are designed to more efficiently build up lateral stresses in the surrounding matrix soils and to allow for a quicker and more efficient pier construction process.

BACKGROUND

Heavy or settlement-sensitive facilities that are located in areas containing soft or weak soils are often supported on deep foundations, consisting of driven piles or drilled concrete piers. The deep foundations are designed to transfer the structure loads through the soft soils to more competent soil strata.

In recent years, aggregate piers have been increasingly used to support structures located in areas containing soft soils. The piers are designed to reinforce and strengthen the soft layer and minimize resulting settlements. The piers are constructed using a variety of methods including the drilling and tamping method described in U.S. Pat. Nos. 5,249,892 and 6,354,766 ("short aggregate piers"), the driven mandrel method described in U.S. Pat. No. 6,425,713 ("Lateral Displacement Pier), the tamper head driven mandrel method known as the "Impact Pier" (U.S. Patent Pending), and the driven tapered mandrel method (U.S. Patent Pending).

The Short Aggregate Pier method (U.S. Pat. Nos. 5,249,892 and 6,354,766), which includes drilling or excavating a cavity, is an effective foundation solution when installed in cohesive soils where the sidewall stability of the hole is easily maintained. The method generally consists of: a) drilling a generally cylindrical cavity or hole in the foundation soil; b) compacting the soil at the bottom of the cavity; c) installing a relatively thin lift of aggregate into the cavity; d) tamping the aggregate lift with a specially designed beveled tamper head; and e) repeating the process to form an aggregate pier generally extending to the ground surface. Fundamental to the process is the application of sufficient energy to the beveled tamper head such that the process builds up lateral stresses within the matrix soil up the sides of the cavity during the sequential tamping. This lateral stress build up is important because it decreases the compressibility of the matrix soils and allows applied loads to be efficiently transferred to the matrix soils during pier loading.

The tamper head disclosed in U.S. Pat. No. 5,249,892 is flat on the bottom and has beveled sides. In commercial practice, the flat bottom portion of the beveled tamper makes up approximately 70% of the tamper cross-sectional area, while the beveled portion comprises only about 30% of the tamper cross-sectional area. Thus, approximately 70% of the tamper cross-sectional area is devoted to the downward compaction of each lift of aggregate (done by the flat bottom portion) and only 30% of the tamper cross-sectional area is devoted to increasing the lateral pressure in the matrix soil (done by the beveled portion). As so constructed, the beveled tamper head of the Short Aggregate Pier method is used most often to compact 12 inch lifts of aggregate in 30 inch diameter holes.

The tamper head driven mandrel method ("Impact Pier" method) is a displacement form of the Short Aggregate Pier method. The "Impact Pier" method consists of driving a hollow pipe (mandrel) into the ground without the need for drilling. The pipe is fitted with a tamper head at the bottom which has a greater diameter than the pipe and which has a flat bottom and beveled sides. The mandrel is driven to the design bottom of pier elevation, filled with aggregate and then lifted, allowing the aggregate to flow out of the pipe and into the cavity created by withdrawing the mandrel. The tamper head is then driven back down into the aggregate to compact the aggregate. The flat bottom shape of the tamper head compacts the aggregate; the beveled sides force the aggregate into the sidewalls of the hole thereby increasing the lateral stresses in the surrounding ground.

The driven tapered mandrel method is another means of creating an aggregate pier with a displacement mandrel. In this case, the shape of the mandrel is a truncated cone, larger at the top than at the bottom, with a taper angle of about 1 to about 5 degrees from vertical. The mandrel is driven into the ground, causing the matrix soil to displace downwardly and laterally during driving. After reaching the design bottom of the pier elevation, the mandrel is withdrawn, leaving a cone shaped cavity in the ground. The conical shape of the mandrel allows for temporary stability of the sidewalls of the hole such that aggregate may be introduced into the cavity from the ground surface. After placing a lift of aggregate, the mandrel is re-driven downward into the aggregate to compact the aggregate and force it sideways into the sidewalls of the hole. Sometimes, a larger mandrel is used to compact the aggregate near the top of the pier.

SUMMARY OF THE INVENTION

The present invention can be referred to as the "Elongated Pyramidal or Conical Tamper Head Rammed Aggregate Pier" method and apparatus and represents an improvement over the prior art aggregate pier methods, especially the Short Aggregate Pier method of U.S. Pat. No. 5,249,892. The present invention utilizes a full-cavity-diameter tamper head having a body in the general shape of an elongated pyramid or cone. More specifically, the pyramidal body has a regular polygon as its base or top and isosceles triangles for its sides which taper toward a point at its bottom tip. Such a pyramidal tamper head body is shown in FIGS. 1, 2A and 2B. The conical body has a generally circular base or top that tapers toward a point at the tip. Such a conical tamper head body is shown in FIGS. 3, 4A and 4B.

The pyramidal and conical tamper heads of the present invention are each sized at their top or base (opposite to the pointed tamping end or bottom tip) to approximate the diameter of the drilled hole or cavity and are designed for maximum build up of lateral stresses in the matrix soil during compaction. Each style tamper head increases in cross-section from the bottom tip of the tamper to the base or top of the tamper at a preferred angle of approximately 60 degrees. The top of the tamper head preferably includes a flat circular plate welded to the base or top of the pyramidal body which is designed to be the same diameter as the diameter of the drilled cavity to be filled. The cross-section of the pyramidal body of the tamper head shown in FIG. 1 is a regular octagon (all eight sides equal in length), although other regular polygon shapes can be used, such as square and hexagonal. The cross-section of the conical body is circular to produce a cone shape.

The elongated pyramidal or conical configuration of the tamper head in accordance with the present invention allows the tamper to be applied to a lift of loosely placed aggregate that is approximately the same depth as the diameter of the tamper base or top which, in turn, approximates the diameter of the hole or cavity to be filled. Thus, for 24-inch diameter holes, aggregate lift thicknesses may be increased from 12-inches (for the prior art tampers) to 24 inches, thus increasing the efficiency of construction. Making the top of the tamper head approximately the same diameter as the hole or cavity to be filled, in accordance with the present invention, provides confinement of the aggregate during the tamping operation. The increase in lateral stress that is afforded by the pyramidal or conical tamper head allows for an increase in pier capacity relative to the prior art tamper heads. Therefore, the present invention simultaneously provides for a more efficient construction process and an increase in pier capacity.

DETAILED DESCRIPTION

Figure 1:
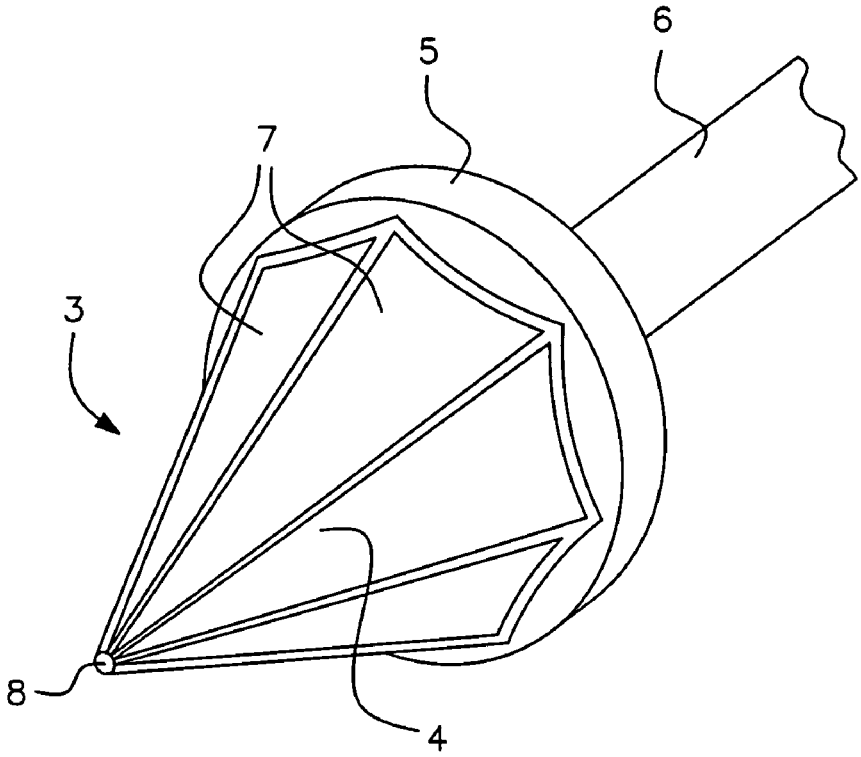
FIG. 1 is a photograph showing a perspective view of a preferred pyramidal tamper head in accordance with the present invention.

Before any embodiment of the invention is explained in detail, it is to be understood that the invention is not limited in its application to the details of construction and arrangements of components set forth in the following description or illustrations in the drawings. The invention is capable of alternative embodiments and of being practiced or carried out in various ways. Specifically, the dimensions as described and where they appear in the drawings are exemplary embodiments only and may be modified by those skilled in the art as the conditions warrant.

Figure 5:
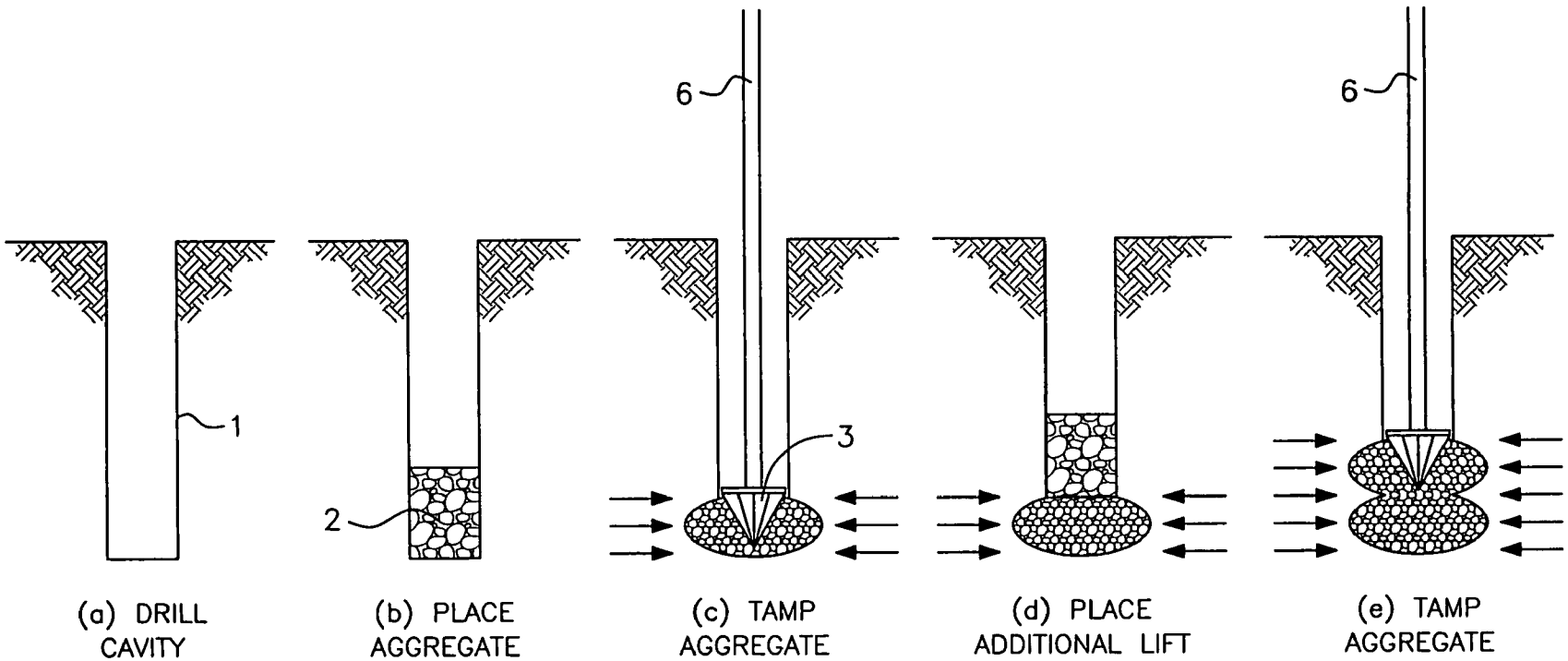
FIG. 5 is a schematic illustration showing the pier construction process in accordance with the present invention, including the forming of a cavity, such as by drilling, placing a first lift of aggregate in the cavity, tamping the aggregate with the pyramidal tamper of FIG. 1 to build up lateral stress, and placing and tamping of an additional lift of aggregate to build the pier to the ground surface.

The method and apparatus of the present invention provides for the efficient installation of aggregate piers in foundation soils. The method as shown in FIG. 5 includes forming an elongated vertical cavity or hole 1 having a generally uniform cross-sectional area in the foundation soils. Preferably, the vertical cavity is generally cylindrical, and formed in any suitable way, such as by drilling. The cavity can also be formed by penetrating and extracting an elongated tube or mandrel.

A lift of aggregate 2 is then placed into the bottom of the hole 1. Because of the configuration of the tamper heads of the present invention, each lift of aggregate placed into the hole can have a thickness in the hole which is approximately equal to the diameter of the cavity. The aggregate lift is then tamped with the pyramidal tamper head 3 or the conical tamper head 13 of the present invention which are especially designed to apply sufficient energy to greatly increase the lateral pressure in the matrix soil surrounding the hole. The pier is completed with the addition and tamping of successive lifts.

The tamper head, whether pyramidal or conical, has a top or base with a cross-wise dimension approximately equal to the cross-wise dimension of the cavity. Where the cavity is generally cylindrical, the cross-wise dimension of the tamper head top approximates the diameter of the cavity.

The methods for making rammed aggregate piers are well known to those skilled in the art and need not be recited here. However, they are expressly incorporated by reference as if fully set forth herein.

Figure 2A:
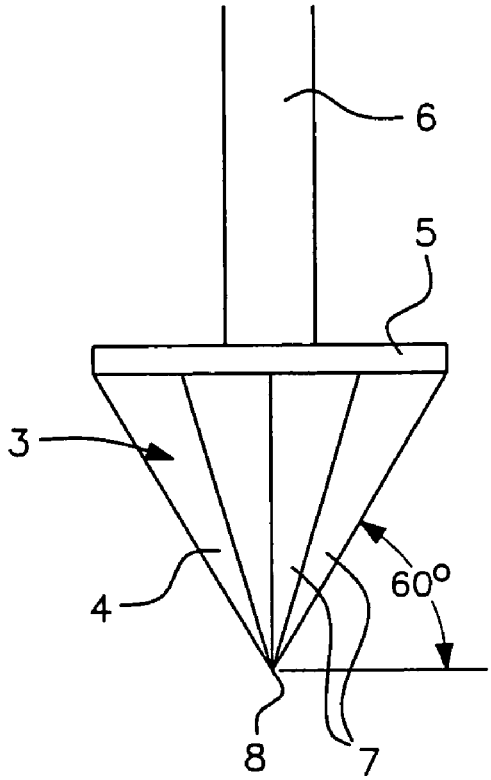
FIG. 2A is a drawing showing a side view of the tamper head of FIG. 1.
Figure 2B:
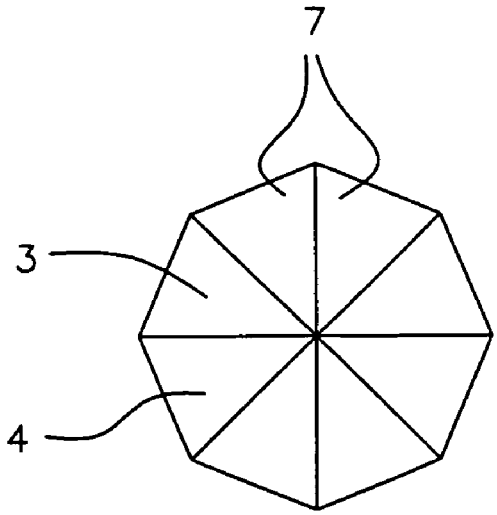
FIG. 2B is a drawing showing a bottom view of the tamper head of FIG. 1.

As shown in FIGS. 1, 2A and 2B, the pyramidal tamper head 3 preferably includes two component parts: an elongated pyramid body 4 and a circular confinement plate 5 welded atop the upward facing base 9 of the pyramid body. The tamper head may also be constructed without a confinement plate.

A conventional tamper rod or mandrel 6 is welded to the top of the confinement plate 5 in order to support the tamper head 3 and apply the requisite energy to the tamper head during tamping of each aggregate lift. The pyramidal body 4 is preferably constructed using ½-inch or ⅜-inch thickness rolled steel that is bent to form the pyramidal body preferably with a regular octagonal base or top. The sides of the body 4 are welded together to form the generally pyramidal shape as shown in FIGS. 1, 2A and 2B.

In a preferred embodiment, the tamper head 3 is 24 inches in diameter at the top of the tamper, i.e., the confinement plate 5 is 24 inches in diameter and the distance between opposite corners of the pyramid body at the top is also 24 inches. The isosceles triangles 7 which form the sides of the pyramidal body are preferably oriented at about 60 degrees from horizontal. This configuration results in a tamper head length of about 21 inches for the tamper head body 4.

Figure 3:
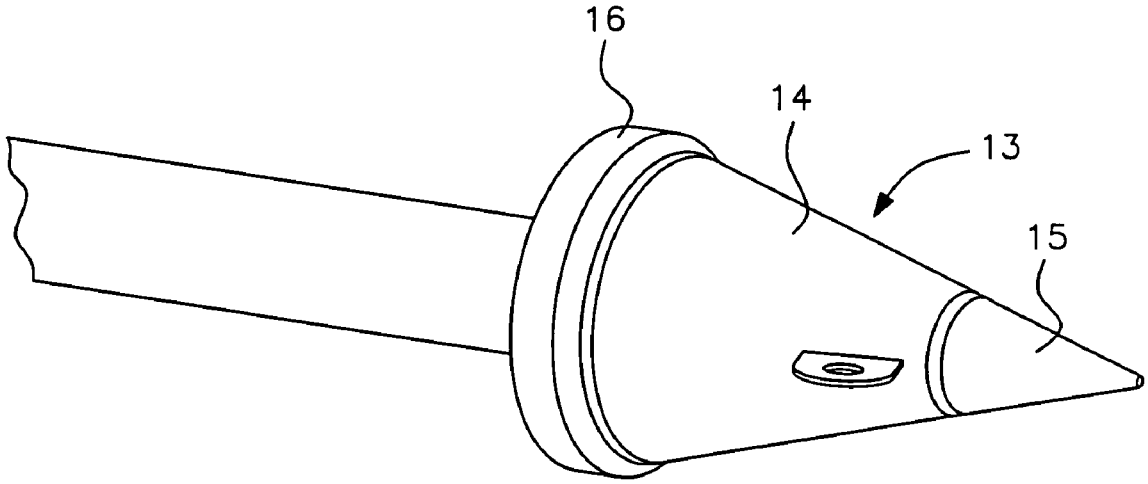
FIG. 3 is a photograph showing a perspective view of a preferred conical tamper head in accordance with the present invention.
Figure 4B:
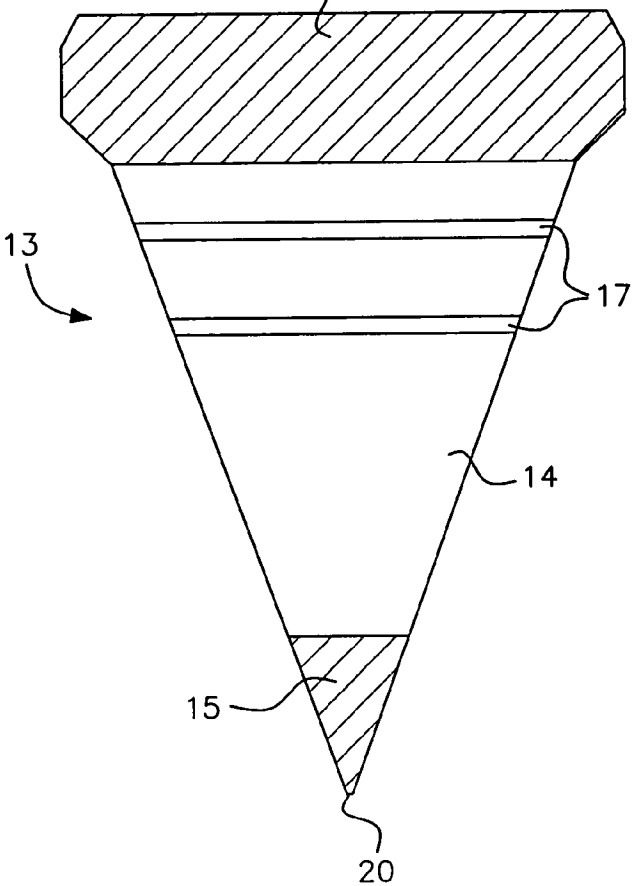
FIG. 4B is a drawing showing a cross-section taken along line B-B of FIG. 4A.
Figure 4A:
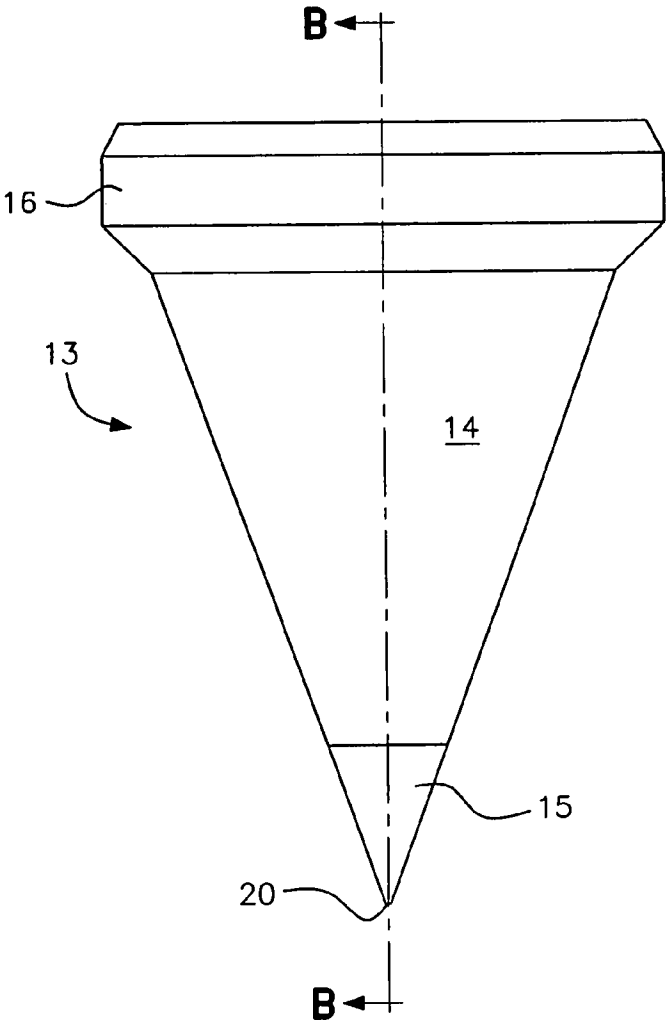
FIG. 4A is a drawing showing a side view of the tamper head of FIG. 3.

The conical tamper head 13 includes a tapered body 14 and a conical tip 15, with the taper of the body 14 corresponding with that of the tip 15 to create a unified taper, as shown in FIGS. 3, 4A and 4B. The tip is solid, preferably of steel, as is the base plate 16 welded to the top of the body 14. The body 14 is essentially hollow, and includes steel gussets 17 on the inner wall 18 for reinforcement, as shown in FIG. 4B. The gussets 17 are approximately ⅝ inches thick and according to a preferred embodiment are spaced three inches on center.

While the tamper head top diameter may change from 24 inches, the diameter is preferably the same as the diameter of the hole 1. Some variance between the diameter of the hole and the diameter of the tamper head top can be tolerated, but the diameter of the tamper head top should not be more than about 10% greater than the diameter of the drilled hole or less than about 90% of the diameter of the drilled hole. The tamper head to drilled hole diameter ratio of about 0.9 to about 1.1 is important so that the top of the tamper head or confinement plate 5, if included, provides confinement to the aggregate 2 during tamping. If the top of the tamper head is too small, the aggregate may push upwards around the top during tamping; if the top of the tamper head is too large, then it pushes a portion of the sidewalls of the hole downward during tamping.

The tamper taper angle is preferably about 60 degrees but may range from as low as about 45 degrees to about 75 degrees from horizontal. The 60-degree tamper head angle allows a 24-inch diameter tamper head to fully compact an approximately 2-foot thick lift of aggregate during compaction and is designed to optimize the lateral stress build up during tamping. The pyramidal and conical tamper heads of the present invention are an improvement over the prior art Short Aggregate Pier method, because the prior art is typically used with one-foot thick lifts of aggregate, requiring the prior art to use more lifts and more time to build the pier, whereas the pyramidal and conical tamper heads of the present invention can compact lifts up to twice as thick. Tamper head angles of less than 60 degrees from horizontal would be applied to lifts of aggregate less than 2 feet in thickness; tamper head angles of greater than 60 degrees would be able to compact thicker lifts but would provide less vertical confinement than tamper heads oriented at 60 degrees from horizontal.

Alternate pyramidal tamper head dimensions and shapes may also be used such as tamper head bodies made from steel to form square, hexagonal, or other articulated cross-sectional shapes. The pyramidal or conical tamper head wall thickness may vary from ¼-inch to one inch, depending on the tamper head diameter, length, tamper head construction materials, and driving conditions. The pyramid body 4 and conical body 14 may be hollow, for which thicker and stronger construction materials should be used, or can include internal support struts or plates, in which thinner or less strong construction materials can be used. As stated previously, the tamper head taper angle may vary from 45 degrees to 75 degrees so long as the tapering sides of the pyramid body 4 or conical body 14 facilitate both the compaction of the aggregate and pushing the aggregate laterally into the sidewalls of the hole to increase the pressure in the surrounding soils.

Preferably, the pyramid body 4 or conical body 14 of the tamper heads 3 converge to a generally pointed end 8 and 20, respectively. However, the pointed ends 8 and 20 may be truncated or blunted. If truncated or blunted, the area of the blunt end should be no more than 20% of the area of the top or base of the tamper body or circular confinement plate. As the end 8 or 20 becomes more blunt, the aggregate lifts which can be properly tamped with the tamping head of the present invention become thinner. Hence, a generally pointed tip is preferred.

For use with the preferred tamping heads 3 and 13 as herein described and illustrated in the drawings, a suitable aggregate consists of "well graded" highway base course aggregate with a maximum particle size of 2 inches and less than 12% passing the No. 200 sieve size (0.074 inches). Alternate aggregates may also be used such as clean stone, maximum particles sizes ranging between ¼-inch and 3 inches, aggregates with less than 5% passing the No. 200 sieve size, recycled concrete, slag, recycled asphalt, cement treated base and other construction materials. The maximum size of the aggregate should not exceed 25% of the diameter of the cavity.

A primary advantage of the present invention is that the pyramidal or conical tamper head is more efficient at building up lateral earth pressure during construction than are the tamper heads described in the prior art. This improved lateral stress buildup is the result of the unique shape of the tamper heads 3 and 13. The pyramidal or conical tamper head devotes up to 100% of its cross-sectional area to lateral stress build-up, compared to about 30% of the cross-sectional area devoted to lateral stress build-up in the prior art. Another advantage is that, because of the increased tamper inclination angle, the tamper head of the present invention can be applied to thicker lifts of aggregate than could be used in the prior art. For the preferred embodiment, this means that the tamper head can be applied to 24-inch to 30-inch thick lifts of loosely placed aggregate. In practice, this means that piers with the same support capacity may now be constructed with smaller diameters and with thicker lift heights.

Figure 6:
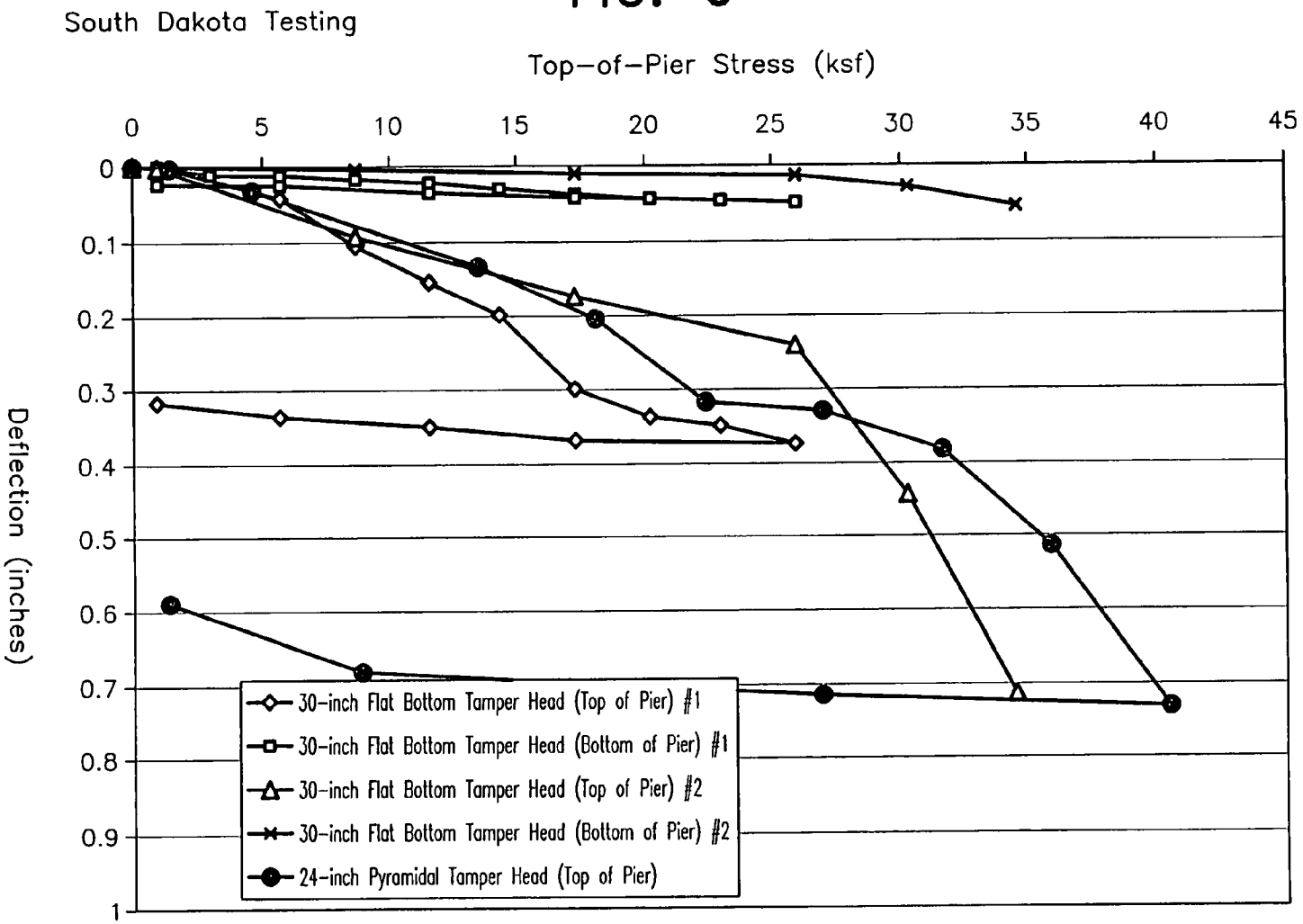
FIG. 6 is a graph plotting load test results from a first test performed on two piers constructed with the prior art (denoted "flat bottom tamper head") and a pier constructed in accordance with the present invention (denoted "pyramidal tamper head").
Figure 7:
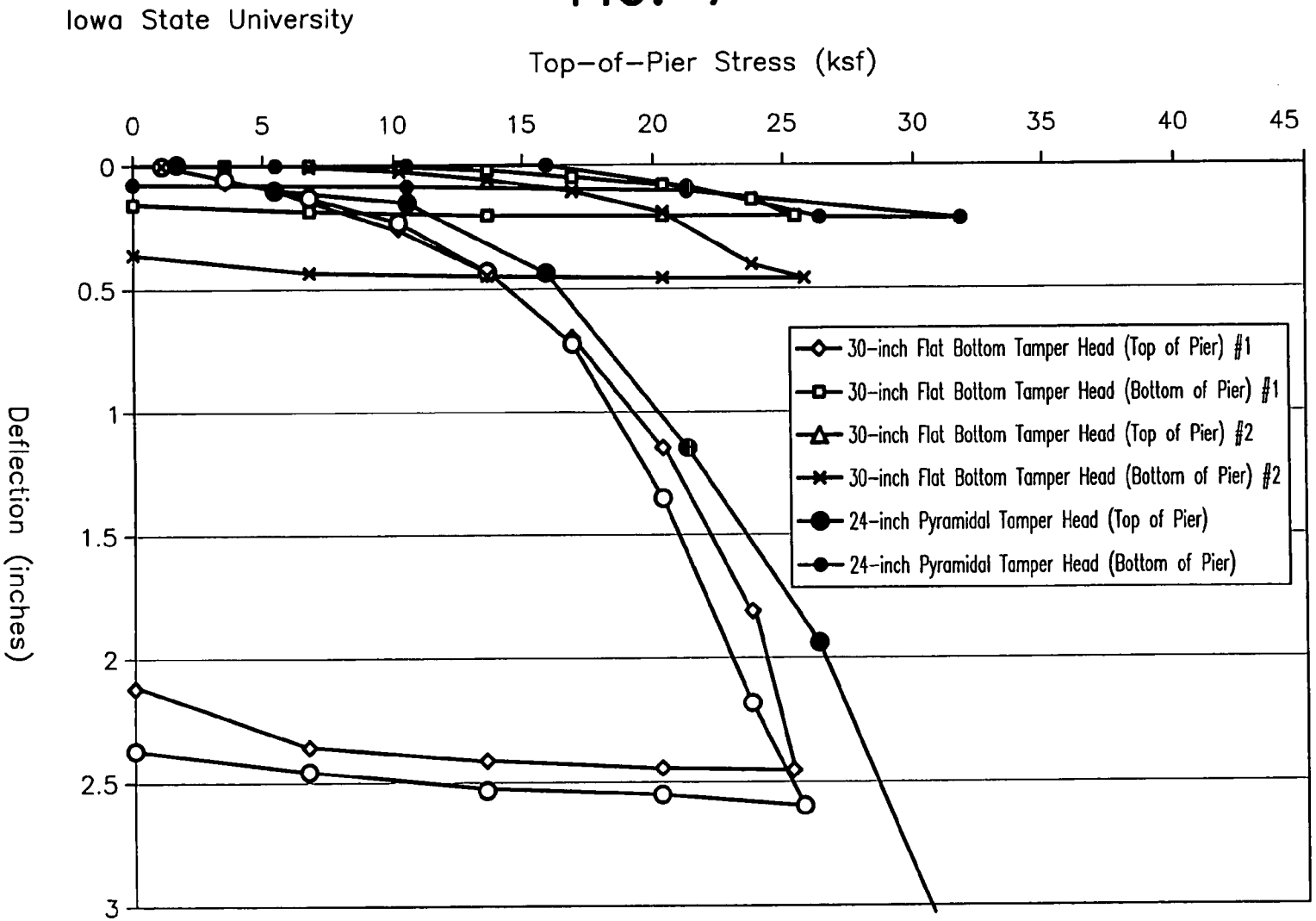
FIG. 7 is a graph plotting load test results from a second test performed on two piers constructed with the prior art (denoted "flat bottom tamper head") and a pier constructed in accordance with the present invention (denoted "pyramidal tamper head").

The advantages described above are shown by load tests conducted on piers constructed using the prior art method and using the present invention, and are summarized in FIGS. 6 and 7. FIG. 6 shows the results of three load tests at a first project site. Two tests (denoted "flat bottom RAP") were conducted on 30-inch diameter piers constructed using the prior art method of U.S. Pat. No. 5,249,892, compacting 12-inch thick aggregate lifts. One test (denoted "pyramidal tamper head RAP") was conducted on a 24-inch diameter pier constructed using a 24-inch diameter, 60 degree pyramidal head as shown in FIG. 1 compacting 24-inch thick aggregate lifts. The results of the tests are plotted in FIG. 6 which shows the relationship between stress that is applied to the tops of the piers during load testing (x-axis) to the resulting deflection that occurs when the stress is applied (y-axis). The ratio of stress to deflection is the stiffness modulus of the pier, where a flatter slope represents a stiffer response. Deflection measurements at the bottom of the piers are also plotted.

The results of the load tests as illustrated in FIG. 6 show that the stiffness at the tops of all three piers is approximately the same until a top pier stress of about 15 kips per square foot (ksf) is applied. When a stress greater than 15 ksf is applied to the piers, the Flat Bottom RAP #1 exhibits a softer response. When a stress greater than about 25 ksf is applied, the stiffness of both Flat Bottom RAP #1 and Flat Bottom RAP #2 are significantly less than the stiffness of the Pyramidal Tamper Head RAP. This is because the Pyramidal Tamper Head Pier constructed in accordance with the present invention more efficiently increases the confining stresses around the pier during construction, providing more strength to the pier during loading. Importantly, if the stiffness of all three piers were equal, the present invention would still provide the advantage in that the pier may be more efficiently constructed than the piers constructed in accordance with the prior art.

FIG. 7 shows the results of three load tests at a second project site. Two tests were conducted on 30-inch diameter piers constructed using the prior art method of U.S. Pat. No. 5,249,892, compacting 12-inch thick aggregate lifts. One test (denoted "conical tamper head") was conducted on a 24-inch diameter pier constructed using a 24-inch diameter, 60 degree pyramidal head as shown in FIG. 1 compacting 24-inch thick aggregate lifts. The results of the load tests show that the stiffness at the tops of all three piers is approximately the same until a top of pier stress of about 10 kips per square foot (KSF) is applied. When a stress greater than 10 kips is applied to the piers, the flat bottom pier results exhibit a softer response. This stiffness of the pier constructed using the pyramid shaped tamper is greater than achieved by the prior art method.

The present invention allows for a much faster construction of aggregate piers due to the fact that construction is facilitated through the use of thicker lifts. At one project site where the present invention was employed, piers were constructed in half the time required to construct piers using prior art approaches. Hence, the faster installation possible using the present invention offers significant benefits in time and cost savings over the prior art.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A method of constructing aggregate piers comprising the steps of:

forming an elongated cavity in a ground surface, said cavity having a sidewall and a generally uniform cross-sectional area;

placing a lift of aggregate into the cavity with a lift thickness approximately equal to a distance across the cavity;

tamping the lift with a pyramidal or conically shaped tamper head having a substantially hollow portion and a top or base approximately equal to said cross-sectional area of the cavity, and a bottom or tip no more than about 20% of the area of the top or base, to increase the lateral stresses in the sidewall of the cavity, wherein the tamper head is sized and configured to connect to and be manipulated by a tamper rod, mandrel or shaft that connects to and communicates a mechanized force from a power source to the tamper head for delivery to the lift of aggregate; and repeating the placing and tamping steps with successive lifts.

2. The method of claim 1 wherein the step of tamping includes using a tamper head having an inclination that varies from about 45 degrees to about 75 degrees from horizontal.

3. The method of claim 1 wherein the step of tamping includes using a tamper head that has a conical shape.

4. The method of claim 3, wherein the step of tamping includes using a tamping head that has a truncated conical shape.

5. The method of claim 1 wherein the step of tamping includes using a tamper head that has a pyramidal shape.

6. The method of claim 5, wherein the step of tamping includes using a tamping head that has a truncated pyramidal shape.

7. The method of claim 1 wherein the elongated cavity is generally cylindrical and the step of tamping includes using a tamper head having a top cross-wise dimension approximately equal to a diameter of the cavity.

8. The method of claim 7 wherein said tamper head top dimension is no less than about 90% and no more than about 110% of the diameter of the cavity.

9. The method of claim 1 wherein the step of placing a lift of aggregate includes using aggregate having at least one of stone with fine materials, recycled concrete, recycled asphalt, slag, and cement treated base.

10. The method of claim 1 wherein the step of forming the cavity is by drilling.

11. The method of claim 1 wherein the step of forming the cavity is by penetrating and extracting an elongated tube or mandrel.

12. The method of claim 11, wherein the step of forming the cavity is by penetrating and extracting a tapered and elongated tube or mandrel.

13. The method of claim 1 wherein the step of tamping includes using a tamper head having a generally pointed bottom or tip and having a circular confinement plate attached to said tamper rod, mandrel, or shaft.

14. The method of claim 1, wherein the step of tamping provides stress build-up including more than 50% lateral stresses in the sidewall of the cavity.

15. An apparatus for forming an aggregate pier in a generally vertical cavity in a ground surface, said cavity having a generally circular cross-section, said apparatus comprising:

a power source configured to generate a mechanized force;

a tamper rod, mandrel or shaft in force communication with said power source and configured to move in response to the mechanized force; and a tamper head comprising a generally pyramidal or conical body tapering toward a point at its lower end and having a cross-section at its upper end which is at least about 90% of said cavity cross-section, said tamper head including a substantially hollow portion and being configured and sized to attach to and be manipulated by the tamper rod, mandrell or shaft, wherein said tamper head receives and delivers the mechanized force from said tamper rod, mandrel or shaft.

16. The apparatus of claim 15, further comprising a circular confinement plate mounted at an upper end of said pyramidal or conical body, said confinement plate having a diameter substantially equal to or greater than a longest dimension of an upper end of said pyramidal or conical body.

17. The apparatus of claim 16, wherein the confinement plate is attached to said tamper rod, mandrel, or shaft.

18. The apparatus of claim 15 wherein said lower end is blunted, and has a blunted area no more than about 20% of an area of the upper end.

19. The apparatus of claim 15, wherein said upper end of the generally pyramidal or conical body has a greatest dimension equal to between about 90% and about 110% of a diameter of said cavity.

20. The apparatus of claim 15, wherein said generally pyramidal or conical body tapers at an angle to horizontal of about 45 degrees to about 75 degrees.

21. The apparatus of claim 20, wherein said generally pyramidal or conical body tapers at an angle to horizontal of about 60 degrees.

22. The apparatus of claim 15 wherein the body has a conical shape.

23. The apparatus of claim 22, wherein said body has a truncated conical shape.

24. The apparatus of claim 15 wherein the body has a pyramidal shape.

25. The apparatus of claim 24 wherein said pyramidal shape is hexagonal in cross-section.

26. The apparatus of claim 24 wherein said pyramidal shape is octagonal in cross-section.

27. The apparatus of claim 24, wherein said body has a truncated pyramidal shape.

28. The apparatus of claim 15 wherein the tamper head upper end has a diameter approximately equal to a diameter of the cavity.

29. The apparatus of claim 15, wherein said tamper head upper end has a greatest dimension equal to between about 90% and about 110% of a diameter of said cavity.

30. A tamper head for forming an aggregate pier in a generally vertical cavity in a ground surface, said cavity having a generally circular cross-section, said tamper head comprising a generally pyramidal or conical body tapering toward a point at its lower end no more than about 20% of a cross-section of an upper end of the body, said upper end cross-section being at least about 90% of said cavity cross-section, said tamper head including a substantially hollow portion and being configured to attach to a tamper rod, mandrel or shaft that communicates a mechanized force from a power source to the tamper head, and wherein the tamper head is sized to be manipulated by said tamper rod, mandrel or shaft.

* * * * *